United States Patent [19]

Knepprath et al.

[11] Patent Number: 5,012,619

[45] Date of Patent: May 7, 1991

[54] METHOD AND APPARATUS FOR FORMING SPHERES

[75] Inventors: Vernon E. Knepprath, Sherman; Jules D. Levine, Dallas, both of Tex.

[73] Assignee: Texas Instruments Incorporated, Dallas, Tex.

[21] Appl. No.: 454,617

[22] Filed: Dec. 21, 1989

[51] Int. Cl.[5] ..... B24B 31/10

[52] U.S. Cl. ..... 51/163.1; 51/163.2; 51/7; 241/39; 241/69

[58] Field of Search ..... 51/163.1, 163.2, 149, 51/156, 7; 241/39, 69, 274, 299

[56] References Cited

U.S. PATENT DOCUMENTS 3,436,868 4/1969 Christensen ..... 51/163.1
4,248,387 2/1981 Andrews ..... 241/39

FOREIGN PATENT DOCUMENTS 1472573 5/1977 United Kingdom ..... 51/149

OTHER PUBLICATIONS

"Subsection Nonrotary Ball or Bead Mills" Perry's Chemical Engineering Handbook, Sixth Edition, McGraw-Hill, 1984.

*Primary Examiner*—Maurina Rachuba
*Attorney, Agent, or Firm*—Melvin Sharp; James T. Comfort; N. Rhys Merrett

[57] ABSTRACT

A method and apparatus for forming silicon spheres (40) from irregular-shaped particles (38) for use in solar cells are disclosed. The apparatus (10) generally comprises a vertically aligned cylindrical chamber (12) having an abrasive lining (32) integrally formed therein. The abrasive lining (32) is preferably a silicon carbide material. A gas source (36) is tangentially injected into the chamber (12) to create an gas vortex inside the chamber (12). This vortex induces the repeated collision of the particles (38) against the abrasive lining (32) to eventually form the silicon spheres (40) and simultaneously sizing the silicon spheres (40).

13 Claims, 2 Drawing Sheets

METHOD AND APPARATUS FOR FORMING SPHERES

TECHNICAL FIELD OF THE INVENTION

This invention relates generally to an apparatus and method for forming spheres, and more particularly, to a method and apparatus for forming silicon spheres for use in a solar array.

BACKGROUND

Recently, a system has been developed which efficiently produces electricity from the sun's radiation and is described in U.S. Pat. No. 4,691,076, assigned to the present assignee. In that system, a solar array is disclosed which uses a plurality of silicon spheres that are housed in a pair of aluminum foil members to form contacts for a P-type and N-type region. Multiple arrays are interconnected to form a module of solar cell elements for converting sunlight into electricity.

An important feature when manufacturing solar cells is the uniform formation and purification of the silicon spheres. In the past, silicon spheres have been manufactured by etching irregular-shaped particles of silicon with an acid or caustic solution. Once the particles had been exposed to the acid or caustic solution, they were melted, which induced the migration of impurities contained within the particles to their surface. Eventually, silicon spheres were formed by repeating the etching and melting steps until the final product was formed.

When forming silicon spheres using the prior etching technique, a low yield resulted due to the agglomeration of the silicon particles during the melting process. Once a silicon agglomerate is formed, the material is useless and must be disposed of due to its abnormal shape. This etching technique has also been considerably expensive due to the cost of chemicals and disposal requirements of the waste products formed during processing. Additionally, it has been found that approximately 95% of the silicon particles were etched away to form the final product, resulting in high costs due to the material loss. Further, once the silicon spheres are formed, a time consuming and expensive additional step has been heretofore required to separate the spheres into size categories before implementation into solar arrays.

Therefore, a need has arisen for a method and apparatus for forming uniform spheres while simultaneously removing impurities, and for separating spheres by size during processing. Such an improved method and apparatus should also reduce chemical costs, chemical losses, and time requirements associated with previously developed sphere forming techniques.

SUMMARY OF THE INVENTION

In accordance with the present invention, an apparatus and method for forming silicon spheres from irregular-shaped particles is disclosed. This invention is able to form uniform silicon spheres and simultaneously categorize the silicon spheres by size while removing impurities from the surface of the particles. The apparatus of the present invention generally comprises a substantially cylindrical chamber having a top plate and bottom plate connected at each end. The interior of the chamber is coated with an abrasive lining preferably made of a silicon carbide material. The chamber has an injection line which is tangentially engaged to the chamber for supplying an air source thereto. In operation, air is controllably injected into the chamber to create an air vortex therein. The irregular-shaped particles contained within the chamber are swept up by the air and repeatedly collide with the abrasive lining such that the irregular-shaped particles eventually become substantially spherical.

After initial abrasion of the particles, the particles are melted which to induce migration of the impurities to the surface. The abrasing process is then repeated to remove the impurities from the surface of the silicon particle. In accordance with the invention, the abrasion process and melting process are repeated until the silicon particles are transformed into silicon spheres.

Since the chamber is aligned substantially vertical, a screening device is assembled to the bottom plate such that the appropriate size of the silicon sphere may be withdrawn during processing. This screening of the spheres may be improved by attaching a vibration system assembled at the base for inducing the flow of silicon spheres through the screen of the bottom plate.

The present invention presents several technical advantages over the conventional apparatus and processes used for forming silicon spheres. The present invention manufactures silicon spheres more efficiently due to its capability to produce uniform silicon spheres and categorize them by size, while simultaneously removing impurities from the surfaces. Additionally, because the present invention does not utilize chemicals which need to be replenished and disposed of, the process is less cumbersome and more cost effective. The present invention is also able to increase the percent yield over prior art devices because of these associated advantages.

BRIEF DESCRIPTION OF THE DRAWINGS

Other aspects of the invention and their advantages will be discerned after studying the Detailed Description in co with the Drawings in which.

DETAILED DESCRIPTION OF THE INVENTION

Figure 1:
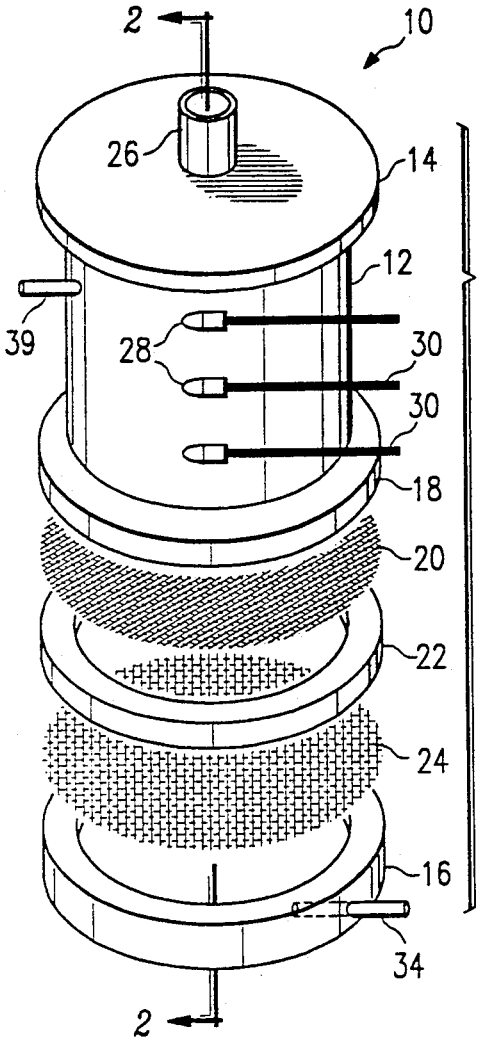
FIG. 1 is an exploded view of a vertical chamber having a device assembled to its bottom plate.

Referring initially to FIG. 1, an exploded view of apparatus in accordance with the present invention generally designed 10 can be seen. Apparatus 10 generally comprises a chamber 12 which is a hollow cylinder aligned substantially vertical. Chamber 12 has a top plate 14 and a bottom plate 16 engaged thereto. As can be seen, bottom plate 16 further comprises an adapter ring 18 which is directly connected to chamber 12. Adapter ring 18 has a first screen 20 held adjacent thereto by a support ring 22. Bottom plate 16 further comprises a second screen 24 held between support ring 22 and bottom plate 16.

Top plate 14 has an outlet air line 26 engaged at its top surface and top plate 14 is removable such that access to the interior of chamber 12 can be obtained by a user. Line 26 has a plurality of holes 27 formed therein, such that gas may pass therethrough. A plurality of injection ports 28 are connected along the sides of chamber 12. Injection ports 28 each have an injection line 30 engageable therewith. Any number of lines 30 may be engaged to ports depending upon desired operation of the present invention.

Figure 2:
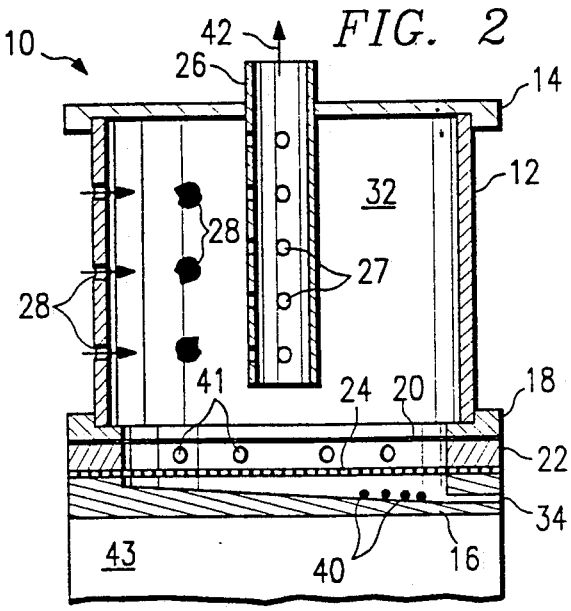
FIG. 2 is a cross-sectional view, as seen along line 2—2 of FIG. 1, illustrating the flow of air which causes particles to re collide with an abrasive lining to form silicon spheres.

Referring now to FIG. 2, the operation of the present invention may be more readily understood. An abrasive lining 32 is formed to the interior of chamber 12. In its preferred embodiment, lining 32 comprises an embedded silicon carbide. In an alternative embodiment, lining 32 may be made of paper or cloth material with silicon carbide or an abrasive material assembled thereon. Lining 32 is preferably a 220-grit material. The grit distribution is a parameter which may be optimized depending upon the smoothness desired for the resulting spheres.

An exit port or outlet line 34 is formed in bottom plate 16 for removing the product.

Initially, a plurality of silicon particles 38 are held within, the interior of chamber 12, only a few particles 38 being shown for ease of illustration. Particles 38 are preferably silicon; however, other material may be used in apparatus 10 for creating the spherical shapes as intended by the present invention. Gas 36 is brought into chamber 12 through ports 28 from an exterior source. Gas 36 is preferably air or an inert gas, such as nitrogen. Gas 36 is injected into chamber 12 in a direction which is substantially tangentical to chamber 12 such that a gas vortex is formed within the interior of chamber 12. This vortex causes particles 38 to sweep around chamber 12 in such a manner as to induce repeated collision with abrasive lining 32. This repeated collision of particles 38 with lining 32 causes particles 38 to become substantially spherical in shape by knocking off edges of particles 38.

In accordance with the present invention, irregular-shaped particles 38 are transformed into spherical-shaped particles by abrasion from lining 32. As particles 38 reduce in size, particles 38 can be transferred through screens 20 and 24, and then sifted through an outlet product line 34 which results in spherical particles 40 formed by repeated abrasion of particles 38 by lining 32. A vibration system 43 may be assembled to bottom plate 16 to induce the sifting of particles 40 from chamber 12. It should be appreciated that a plurality of marbles 41 are positioned between screens 20 and 24 such that vibration system 43 causes marbles 41 to hit screen 20 to reduce clogging of screen 20.

Vibration system 43 is used to induce the flow of particles 40 from within chamber 12 through screens 20 and 24, out of exit port 34. The size of particle 40 leaving chamber 12 is dependant upon the mesh size of screens 20 and 24. Accordingly, the sifting of chamber 12 by vibration system 43 permits simultaneous size separation of particles 40 and abrasion of particles 38.

Gas 36, which is brought into chamber 12, exhausts through exit line 26 in the direction of an arrow 42. Exit line 26 may be assembled with a filtration system for purification of gas 36, such that the particulates will not cause environmental problems.

Figure 3:
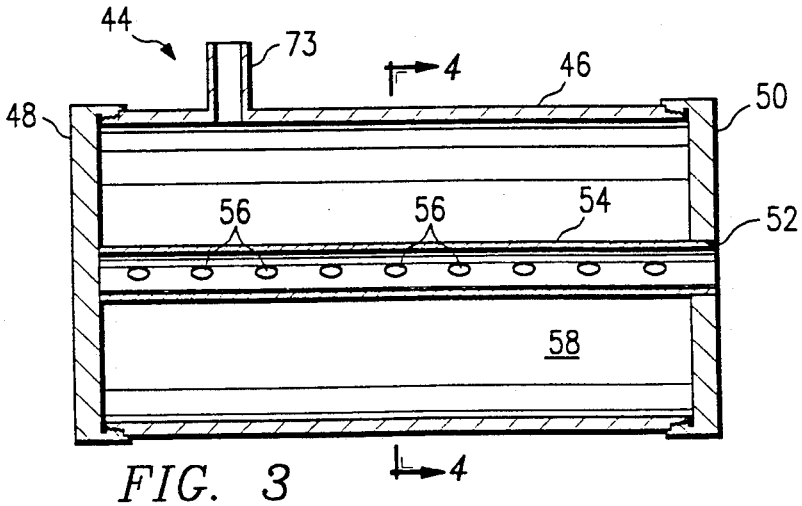
FIG. 3 is a cross-sectional view of an alternative embodiment having a chamber which is substantially horizontal.

Referring now to FIG. 3, an alternative embodiment of the present invention generally designated 44 can be seen. Apparatus 44 generally comprises a substantially horizontal chamber 46 with end plates 48 and 50 engaged at each end. End plate 48 is threadably engaged to chamber 46. A tube 54 is coaxially aligned with chamber 46 and connected at end plates 48 and 50. Tube 54 has a plurality of holes 56 formed therein, such that gas may pass therethrough. Tube 54 is connected to end plate 50 at connection point 52. As with the preferred embodiment, chamber 46 has an abrasive material held on a lining 58 attached to the inner walls of chamber 46. Lining 58 is preferably a silicon carbide material embedded within the interior of chamber 46.

Figure 4:
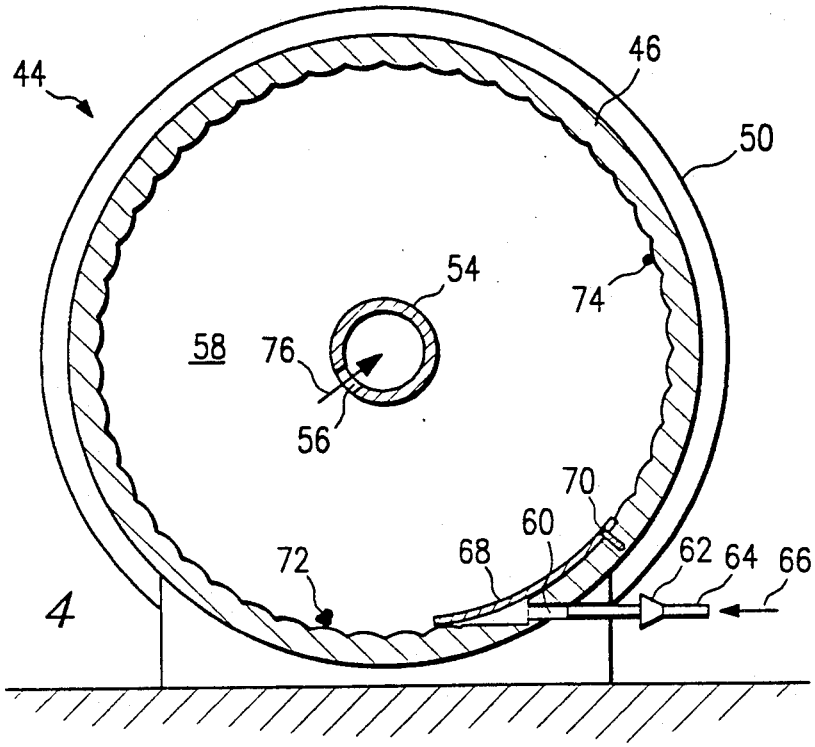
FIG. 4 is a cross-sectional view, as seen along line 4—4 of FIG. 3, illustrating an air injection line connected to the chamber.

Referring now to FIG. 4, a cross-sectional view as seen along line 4—4 of FIG. 3 can be seen. An inlet port 60 is formed within the wall of chamber 46. Inlet port 60 has a couple 62 connected thereto such that a line 64 may be threadably engaged to couple 62.

In operation, a gas source 66, which is preferably an air supply, is brought through line 66 into inlet port 60. Gas source 66 is tangentially aligned with chamber 46 for sweeping air along the interior of chamber 46. A deflection plate 68 is connected to chamber 46 by a screw 70 for permitting air to pass into chamber 46 to cause an air vortex within chamber 46. This vortex within chamber 12 causes an irregular-shaped silicon particle 72 to repeatedly collide with abrasive lining 58 to form a substantially spherical-shaped particle 74. Gas source 66 exits through tube 54 in the direction of arrow 76 and into a filter system which removes any particulates which may pass into the atmosphere.

In the preferred embodiment and the alternative embodiment, a continuous system may be incorporated by adding an inlet line 39 and 73 for permitting irregular-shaped silicon particles 38 and 72 to enter through chamber 12 and 46 as seen in FIGS. 1 and 3, respectively. However, this optional feature is not required in order to operate the present invention.

Figure 5:
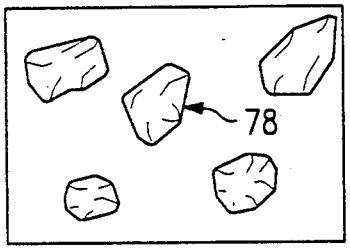
FIGS. 5–10 are sequential views illustrating the steps of formation of silicon spheres in accordance with the present invention.

Referring now to FIGS. 5–10, the operation of the apparatus is more readily appreciated by studying the sequential steps of particle formation in accordance with the present invention. In FIG. 5, raw material 78 is introduced into the apparatus and is generally comprised of irregular-shaped silicon particles. The silicon material contains impurities which must be removed before use in a solar cell. Raw material 78, which is used to form particles, is initially melted by setting the temperature of the furnace to approximately 1450 degrees Centigrade (° C) and holding it at that temperature for approximately 10 minutes.

Figure 6:
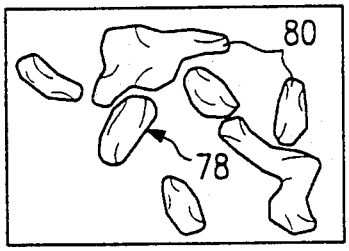

Referring now to FIG. 6, after particles 78 are melted, they are cooled to recrystallize until they become smooth in appearance. Particles 78 may form agglomerates 80. The remelting/recrystallization steps cause the impurities to migrate to the surface of the individual particles 78.

Figure 7:
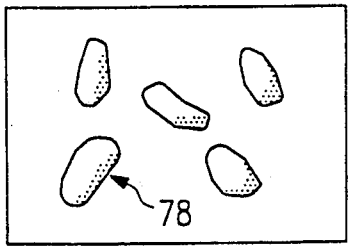

Referring now to FIG. 7, particles 78 are introduced into the apparatus of the present invention as shown in FIGS. 1–4 and are smoothened by the repeated collision against the abrasive surface of the invention. This continued abrasion causes particles 78 to become spherical in shape. As can be observed, the particles are somewhat dull due to the continued abrasion of the particles.

Figure 8:
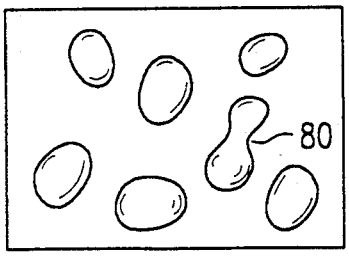

Referring now to FIG. 8, the next feature of the invention can be seen. After particles 78 have gone through the abrasion process, particles 78 are remelted to become more spherical in shape. Additionally, the impurities within particles 78 move closer to the surface as intended by the invention. The transformation of the dull-looking surface to a shiny surface may be visually monitored with each remelting step. Agglomerates 80 are created during each remelting process which will break up and become individual particles 78 during the next abrasion cycle. In prior art techniques, agglomerates 80 would not break and separate due to the wet etchants used, such as acids and caustics. Accordingly, the yield of prior art was much less than that of the present invention because agglomerates 80, which formed during the remelting process, were unable to be utilized.

The agglomerates 80 are again subjected to abrasion by cycling through the apparatus of FIGS. 1-4.

Figure 9:
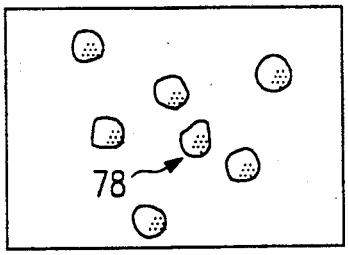

Referring to FIG. 9, the results of continued abrasion abrasion of particles 78 can be seen after final abrasion in the apparatus of FIGS. 1-4. Even though the particle size is much smaller, it is not the final product as intended by the present invention. However, particles 78 become increasing spherical in shape as the abrasion/-remelt process steps continue.

Figure 10:
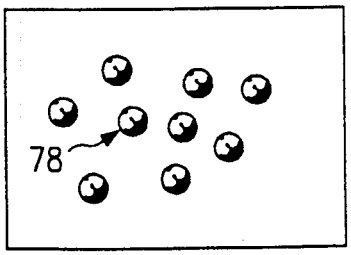

Referring now to FIG. 10, the final product of the present invention can be seen after final remelt process. These particles 78 tend to be uniform in size and shape. At this point, the impurities have been removed from the silicon spheres. This final product, as illustrated in FIG. 10, represents the result of four (4) abrasion and five (5) melting sequences. The present invention can be more easily understood by referring to the example as set forth below:

EXAMPLE

In the laboratory, a plurality of raw silicon particles were initially melted by placing the particles in a furnace at approximately 1450° C. for approximately 10 minutes to permit impurities to migrate to the surface of the individual particles. After the melting process, a first abrasion step was conducted, which lasted approximately six hours, to reduce the size of the particles from 36 mils to 27 mils. The abrasion liner was approximately 220 grit. The volume of the chamber was approximately 3 liters. The pressure of the gas brought into the chamber was approximately 80 psi which supplied sufficient energy to create a vortex effect within the chamber. After the particles were removed from the chamber, they were remelted by setting the temperature to approximately 1450 ° C. for approximately 10 minutes. After the first remelting process, a second abrasion step was conducted for approximately 3 hours, which reduced the size of the particles from 27 mils to 25 mils. After the second abrasion step was conducted, a second remelting process was performed by again setting the temperature of the furnace to approximately 1450 ° C. for approximately 10 minutes. The transformation of the particle surface from dull to shiny was visually monitored to determine the necessary time to remelt the particles.

A third abrasion step and third remelting step were conducted by placing the particles into the chamber for approximately 30 minutes which reduced the size of the particles from 25 mils to 23 mils. The third remelting step was conducted at a furnace temperature of approximately 1450 ° C. which was held for approximately 10 minutes.

The final abrasion step was conducted by placing the particles into the chamber for approximately 15 minutes which further reduced the particles size from 23 mils to 21 mils. After the final abrasion step, a fourth and find remelt followed by a chemical acid etch was conducted by applying a hydrofluoric/nitric/acetic acid mix to the particles. This etching step was performed to insure that all slags and impurities, which may have developed during the fourth remelting step, were removed from the surface of the particles.

It has been found that when utilizing this abrasion and melting process, the number of prior remelting steps necessary are reduced from five (5) to four (4).

The present invention presents technical advantages over prior art because it simultaneously sizes and shapes silicon particles to create a silicon sphere which is capable of being utilized in solar. cells. Additionally, the present invention is more cost effective than the prior art because the extent of chemicals used and disposed of is greatly reduced.

While the preferred embodiments of the invention and their advantages have been disclosed in the above-detailed description, the invention is not limited thereto but only by the spirit and scope of the appended claims.

What is claimed is:

1. An apparatus for forming spheres from irregular-shaped particles, which comprises:

a chamber;

an abrasive material secured to the inner surface of said chamber; and a gas source connected to said chamber for injecting gas into said chamber to cause the particles to repeatedly collide with said abrasive material to form the spheres.

2. The apparatus as recited in claim 1, wherein said chamber comprises a substantially cylindrical wall supporting said abrasive material.

3. The apparatus as recited in claim 2, wherein said gas source is tangentially connected to said chamber to cause a vortex within said chamber when said gas is injected into said chamber, such that said particles are circularly moved around said abrasive material.

4. The apparatus as recited in claim 1, wherein said chamber has an opening for exhausting said gas.

5. The apparatus as recited in claim 1, and further comprising:

sifting apparatus associated with said chamber for inducing the separation of said spheres, such that the size distribution of said spheres be controlled.

6. The apparatus as recited in claim 1, further comprising a plurality of inlet ports connected to the sides of said chamber to induce a vortex action to particles within said chamber.

7. The apparatus as recited in claim 1, wherein said abrasive material comprises silicon carbide.

8. An apparatus for transforming irregular-shaped particles to spherical particles, which comprises:

a substantially cylindrical chamber having a top plate and a bottom plate engaged at each end for containing the irregular-shaped particles;

an abrasive lining formed on the interior sides of said chamber;

an inlet line tangentially connected to said chamber;

a gas source coupled to said inlet line for injecting gas into said chamber to form an gas vortex within said chamber, such that the irregular-shaped particles repeatedly collide with said abrasive lining for creating spherical particles.

9. The apparatus as recited in claim 8, wherein said abrasive lining comprises a silicon carbide material.

10. The apparatus as recited in claim 8, wherein said top plate further includes an outlet air line for exhausting said gas from said chamber.

11. The apparatus as recited in claim 8, wherein said bottom plate further includes an outlet product line for selectively removing the spherical particles.

12. The apparatus as recited in claim 11, wherein said outlet product line comprises a screen of a predetermined mesh size for selectively removing the spherical particles.

13. The apparatus as recited in claim 8, further comprising an inlet product line formed in the side of said chamber for permitting the irregular-shaped particles to continuously flow into said chamber.

* * * * *